US006055407A

United States Patent [19]

Inoue et al.

[11] Patent Number: 6,055,407

[45] Date of Patent: Apr. 25, 2000

[54] SHEET FEEDING DEVICE AND IMAGE FORMING APPARATUS HAVING THE SHEET FEEDING DEVICE

[75] Inventors: Ryukichi Inoue, Abiko; Akihiro Toma, Kanagawa-ken; Jun Tanaka, Chichibu, all of Japan

[73] Assignee: Canon Kabushiki Kaisha, Tokyo, Japan

[21] Appl. No.: 09/263,080

[22] Filed: Mar. 8, 1999

[30] Foreign Application Priority Data

Mar. 10, 1998 [JP] Japan ..... 10-058579
Mar. 11, 1998 [JP] Japan ..... 10-060210

[51] Int. Cl.[7] ..... G03G 21/00

[52] U.S. Cl. ..... 399/381; 399/411; 399/98; 271/119

[58] Field of Search ..... 399/381, 411, 399/98; 271/119, 109

[56] References Cited

U.S. PATENT DOCUMENTS 4,843,436 6/1989 Evangelista et al. .
5,138,390 8/1992 Miyabayashi et al. .
5,158,276 10/1992 Toma ..... 271/9
5,227,844 7/1993 Bhattacharjee et al. .
5,253,854 10/1993 Tanoue et al. ..... 271/10
5,292,116 3/1994 Inoue et al. ..... 271/157
5,348,284 9/1994 Ishihama et al. ..... 271/160
5,358,230 10/1994 Ikemori et al. ..... 271/114
5,553,845 9/1996 Sawa et al. ..... 271/314
5,651,540 7/1997 Watanabe et al. ..... 271/10.12

FOREIGN PATENT DOCUMENTS 53-106130 9/1978 Japan .
57-037942 3/1982 Japan .

*Primary Examiner*—Richard Moses
*Attorney, Agent, or Firm*—Fitzpatrick, Cella, Harper & Scinto

[57] ABSTRACT

This specification discloses a sheet feeding device for feeding a sheet comprising sheet supporting means for supporting the sheet thereon, a sheet feeding roller for contacting with the sheet supported on the sheet supporting means and feeding the sheet, and cleaning means for contacting with that portion of the sheet feeding roller which contacts with the sheet, and cleaning the contacting portion, the sheet feeding roller having a cut-away portion which does not contact with the sheet, secondary cleaning means for cleaning the cleaning means being provided in the cut-away portion. The specification also discloses an image forming apparatus provided with such sheet feeding device.

24 Claims, 17 Drawing Sheets

SHEET FEEDING DEVICE AND IMAGE FORMING APPARATUS HAVING THE SHEET FEEDING DEVICE

BACKGROUND OF THE INVENTION

1. Field of the Invention

This invention relates to a sheet feeding device for feeding sheets by sheet feeding means having a sheet feeding roller, and an image forming apparatus provided with the sheet feeding device, and particularly to a structure for effecting the cleaning of the sheet feeding roller of the sheet feeding device.

2. Description of the Related Art

Heretofore, in a sheet feeding device for feeding sheets by sheet feeding means having a sheet feeding roller, there has been one provided with a brush member as cleaning means for cleaning the sheet feeding roller, and this brush member, as described in Japanese Laid-Open Patent Application No. 53-106130 or Japanese Laid-Open Utility Model Application No. 57-37942, is disposed in such a manner as to always contact with the sheet feeding roller.

FIG. 19 of the accompanying drawings shows the construction of a sheet feeding device having such a brush member mounted thereon, and in FIG. 19, the reference numeral 200 designates a sheet feeding roller. This sheet feeding roller 200 is provided with sheet feeding roller rubber 205 forming the surface of the roller and having a high coefficient of friction, a sheet feeding roller collar 206 fixing the sheet feeding roller rubber 205 and held by a sheet feeding shaft 207 suitably rotated by drive means and control means, not shown, a sheet feeding roller 208 for depressing the upper surface of a sheet bundle S at first, and an idler roller 209 for spacing a sheet apart from the sheet feeding roller 200 while after the sheet feeding operation, the trailing end of a sheet conveyed by a conveying device or the like, not shown, remains in a sheet supply tray 201, and being rotatable to thereby minimize the resistance force received by the sheet.

On the other hand, in FIG. 19, the reference numeral 217 denotes a roller cleaning brush which is cleaning means, and design is made such that this roller cleaning brush 217 removes paper powder resulting from the sheets formed of a fibrous material, a filler or the like which adheres to the surface of the sheet feeding roller rubber 205. The reference numeral 218 designates a brush holder for holding the roller cleaning brush 217, and this brush holder 218 is mounted on the frame member 219 of an image forming apparatus provided with the sheet feeding device.

Design is made such that by the paper powder formed of fibers or a filler which thus adheres to the surface of the sheet feeding roller rubber 205 being scraped off by the roller cleaning brush 217, the frictional force of the sheet feeding roller rubber 205 which is necessary for sheet feeding can be maintained for a certain degree of period.

In such a prior-art sheet feeding device, however, when such paper from the surface of which fibrous paper powder is simply stripped off is fed, a great deal of paper powder adheres to the surface of the roller rubber. When a great deal of paper powder adheres to the surface of the roller rubber, this paper powder comes to accumulate on the brush because, as already described, the roller cleaning brush 217 is designed to always contact with the sheet feeding roller 200 in its fixed state.

When the paper powder thus accumulates on the brush, there has been the problem that the cleaning effect is lost and bad sheet feeding occurs.

Also, in the case of an image forming apparatus of a construction in which for example, a sheet feeding device is disposed in the lower portion, a sheet feeding roller is disposed in the inner part of the bottom of the image forming apparatus, and a roller cleaning brush for cleaning the sheet feeding roller is disposed at a location more difficult of access by a hand. This has led to the problem that the interchange of the sheet feeding roller and the roller cleaning brush is troublesome.

SUMMARY OF THE INVENTION

The present invention has been made in order to solve the above-noted problems, and has as its object to provide a sheet feeding device in which adhering matter such as paper powder adhering to cleaning means can be removed and the interchange of a sheet feeding roller and the cleaning means can be simply effected and further, the frequency of the interchange of the sheet feeding roller and the cleaning means can be reduced, and an image forming apparatus provided with the sheet feeding device. Also, a sheet feeding device for feeding sheets of the present invention has sheet supporting means for supporting the sheets, a sheet feeding roller for contacting with the sheets supported by the sheet supporting means to thereby feed the sheets, and cleaning means for contacting with the portion of contact between the sheet feeding roller and the sheets to thereby clean the portion of contact, and the sheet feeding roller has a cut-away portion which does not contact with the sheets, and secondary cleaning means for cleaning the cleaning means is provided in the cut-away portion.

DESCRIPTION OF THE PREFERRED EMBODIMENTS

Some embodiments of the present invention will hereinafter be described in detail with reference to the drawings.

Figure 1:
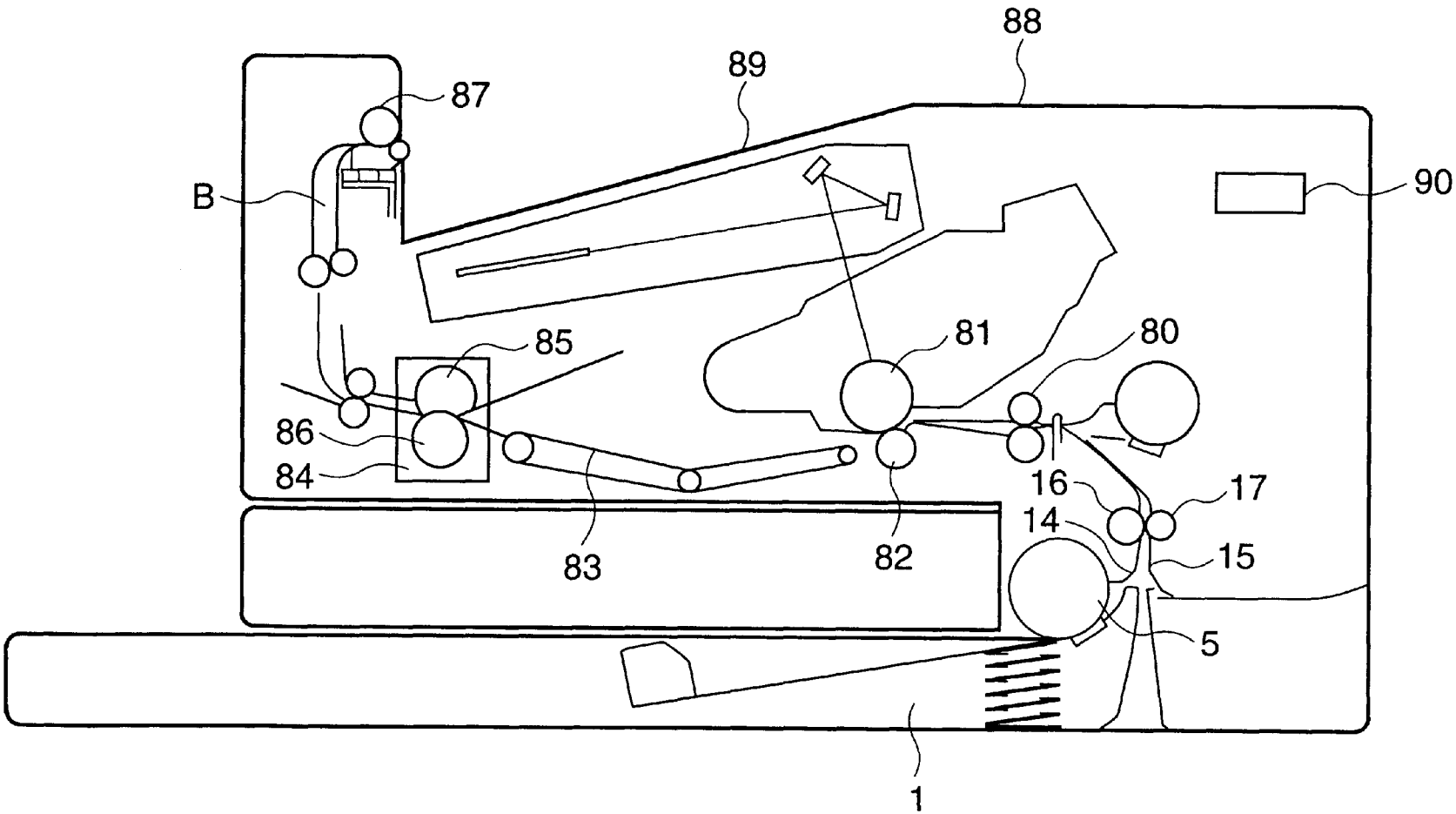
FIG. 1 schematically shows the construction of an image forming apparatus provided with a sheet feeding device using the present invention.

FIG. 1 shows the construction of an image forming apparatus provided with a sheet feeding device using the present invention.

In such an image forming apparatus, sheets fed one by one from a sheet supply tray 1 by a sheet feeding roller 5 may be guided by first and second conveyance guides 14 and 15 and be subjected to a strong conveying force with the leading end thereof brought into a nip constituted by a conveying roller 16 and a conveying roller 17, and be conveyed to registration rollers 80.

Thereafter, timing is taken so that when the leading end position of a developed image formed on a photosensitive drum 81 arrives at the position of a transfer nip portion in which the photosensitive drum 81 and a transfer roller 82 are in contact with each other, the rotation of the registration rollers 80 may be controlled and the leading end of the sheet may be conveyed to the transfer nip portion. The photosensitive drum 81, the transfer roller 82, etc. together constitute an image forming portion which is image forming means.

In such a manner, in the transfer nip portion, the developed image on the photosensitive drum 81 is transferred to the sheet, whereafter the sheet is separated from the photosensitive drum 81 and is conveyed to a fixating device 84 by a conveying belt 83. In this fixating device 84, the sheet is pressed between a heating member 85 and a pressing roller 86, whereby the unfixated image transferred to the sheet is fixated. Thereafter, the sheet on which the toner image has been fixated is passed through a conveying path B and is discharged onto the tray 89 of an image forming apparatus body 88 by a pair of sheet discharging rollers 87.

Figure 2:
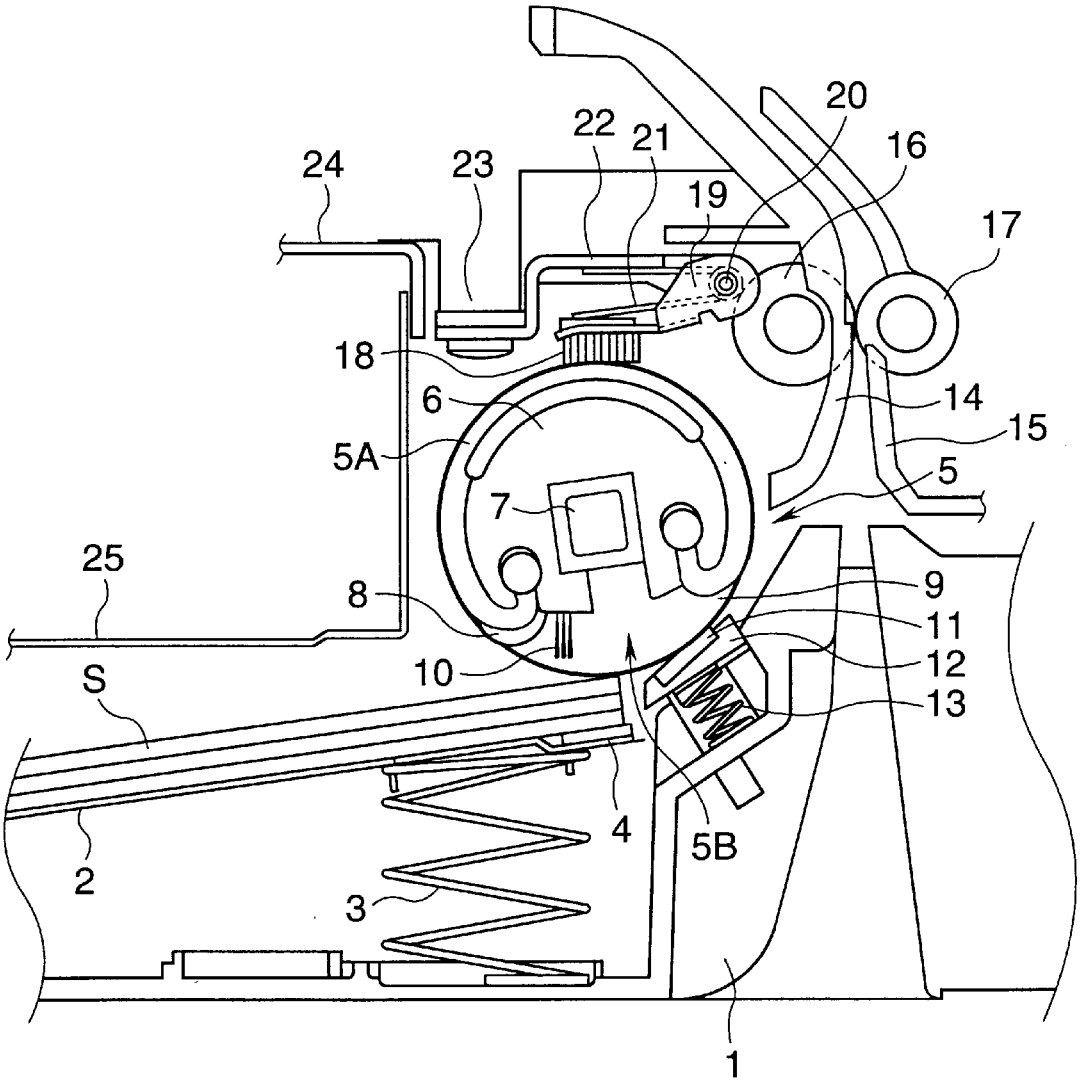
FIG. 2 is a schematic cross-sectional view showing the construction of a sheet feeding device according to a first embodiment of the present invention.

FIG. 2 is a schematic cross-sectional view showing the construction of a sheet feeding device according to a first embodiment of the present invention.

In FIG. 2, a sheet supply tray 1 is removed from the sheet feeding device when a sheet bundle is to be set in the sheet feeding device, and it is again mounted on the sheet feeding device after the sheet bundle has been put into the sheet feeding device. An intermediate plate 2 supports the piled sheet bundle S and presses the sheet bundle toward a sheet feeding roller 5 which is a sheet feeding force generating source which will be described later. An intermediate plate spring 3 presses the underside of the intermediate plate 2 to thereby push up the intermediate plate 2, and a separating sheet 4 generates a frictional force with the lowermost sheet and prevents the double feeding of the last sheet.

A sheet feeding roller 5 is provided with sheet feeding roller rubber 5A which is a sheet-contacting portion forming the surface of the roller and having a D-cut shape having a high coefficient of friction, a sheet feeding roller collar 6 fixing the sheet feeding roller rubber 5A and having a D-cut shape held on a sheet feeding square shaft 7 suitably rotated by driving means, not shown, controlled by a control device 90 shown in FIG. 1, a sheet feeding roller 8 for depressing the upper surface of the sheet bundle S at first, and an idler roller 9 for spacing the sheet and the sheet feeding roller rubber 5A apart from each other while after the sheet feeding operation, the trailing end of the sheet conveyed by a conveying device or the like, not shown, remains in the sheet supply tray 1, and being rotatable to thereby minimize a resistance force the sheet receives.

Design is made such that by the provision of the above-described sheet feeding roller rubber 5A and sheet feeding roller collar 6 having the D-cut shape, a cut-away portion 5B which does not contact with the sheet is formed in the outer peripheral surface of the sheet feeding roller 5.

The reference numeral 18 designates a roller cleaning brush which is cleaning means for removing any paper powder resulting from the sheets formed of a fibrous material, a filler or the like which adheres to the surface of the paper feeding roller rubber 5A, and this roller cleaning brush 18 is held by a brush holder 19. The reference numeral 22 denotes a brush base on which the brush holder 19 is rotatably held through a rotation shaft 20.

The reference numeral 21 designates a brush spring having one end thereof locked by the brush base 22 and the other end thereof locked by the brush holder 19, and generating a force for urging the brush holder 19 toward the sheet feeding square shaft 7, and by the spring force of this brush spring 21, the roller cleaning brush 18 may be brought into contact with the sheet feeding roller rubber 5A with appropriate pressure. The reference numeral 23 denotes a frame for holding the brush base 22, and the reference numerals 24 and 25 designate casings for protecting electrical parts, not shown.

The reference numeral 10 denotes a scraper which is secondary cleaning means provided on the sheet feeding roller collar 6 in the cut-away portion 5B of the sheet feeding roller 5, and this scraper 10 is adapted to bear against the roller cleaning brush 18 during each rotation of the sheet feeding roller 5 and effect the cleaning of the roller cleaning brush 18. By thus effecting the cleaning of the roller cleaning brush 18 during each rotation of the sheet feeding roller 5, the accumulation of paper powder on the roller cleaning brush 18 can be prevented.

On the other hand, the reference numeral 11 designates a separating pad for preventing the double feeding of the sheets, the reference numeral 12 denotes a separating pad holder for holding the separating pad 11, the reference numeral 13 designates a separating pad spring having one end thereof held on the sheet supply tray 1 and the other end thereof pushed against the separating pad holder 12 to thereby urge the separating pad 11 toward the sheet feeding square shaft 7, the reference numerals 14 and 15 denote first and second conveyance guides for determining the direction of conveyance of the sheets, the reference numeral 16 designates a conveying roller for conveying the fed sheets, and the reference numeral 17 denotes a conveying roller opposed to the conveying roller 16 and forming a nip therewith.

Description will now be made of the sheet feeding operation of the sheet feeding device constructed as described above.

A sheet bundle S is piled on the intermediate plate 2 of the sheet supply tray 1 drawn out by a user, and the sheet supply tray 1 is again mounted on the sheet feeding device, whereby the sheet bundle S is set in the sheet feeding device. In thus set state, the sheet bundle S receives the biasing force of the intermediate plate spring 3 and contacts with the idler roller 9.

When thereafter, the sheet feeding operation is started, the sheet feeding square shaft 7 is rotated, whereby the sheet feeding roller collar 6 and the sheet feeding roller rubber 5A, i.e., the sheet feeding roller 5, start to rotate at a time and contact with the sheet.

This sheet feeding roller 5 then contacts with the uppermost surface of the sheet bundle S pushed up by the biasing force of the intermediate plate spring 3, and applies a frictional force to the uppermost sheet. In response to this force, at least the uppermost sheet begins to advance, and soon arrives at the nip formed by the sheet feeding roller 5 and the separating pad 11 biased by the separating pad spring 13.

At this nip, the other sheets than the uppermost sheet are stopped and only the uppermost sheet is fed forwardly by the handling effect by the frictional force and the wedge shape of the separating pad 11. Thereafter, as shown in FIG. 3, this sheet Sf is guided by the first and second conveyance guides 14 and 15, and the leading end thereof comes into the nip formed by the conveying roller 16 and the conveying roller 17 and receives a strong conveying force, and the sheet Sf is conveyed to the image forming portion or the like.

When the sheet is thus fed, and particularly when a sheet of weak surface strength is used, paper powder and a filler produced from the sheet adhere to the sheet feeding roller rubber 5A, but these are removed by the roller cleaning brush 18 pushed against the sheet feeding roller rubber 5A by the brush spring 21.

Figure 3:
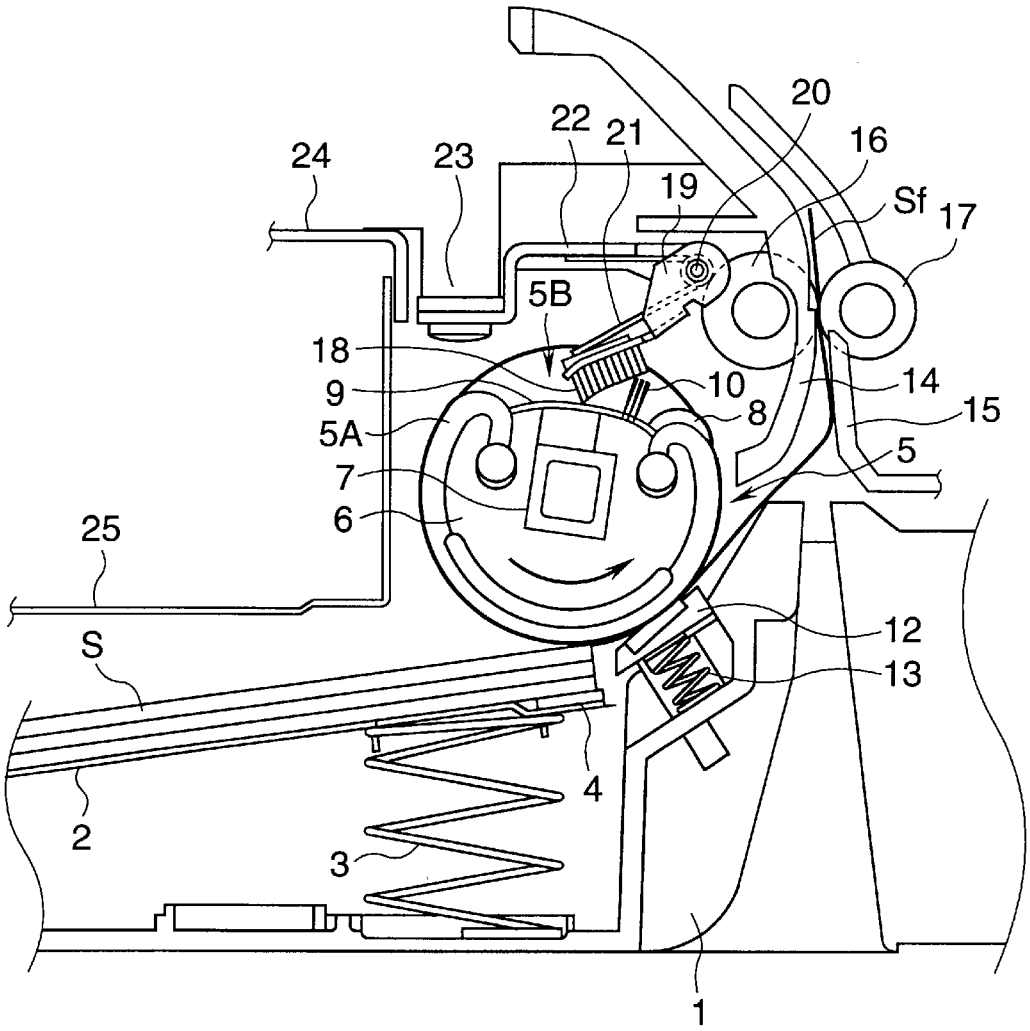
FIG. 3 illustrates the roller cleaning and brush cleaning operation of a scraper according to the first embodiment.

Now, when the sheet feeding roller 5 is rotated to a position in which the sheet Sf thus comes into the nip formed by the conveying roller 16 and the conveying roller 17, the cut-away portion 5B of the sheet feeding roller 5 assumes a position in which it faces upwardly as shown in FIG. 3, i.e., a position in which it faces the roller cleaning brush 18, whereby the roller cleaning brush 18 comes into the cut-away portion 5B by the biasing force of the brush spring 21.

On the other hand, when the sheet feeding roller 5 is further rotated after the roller cleaning brush 18 has thus come into the cut-away portion 5B, the scraper 10 provided in the cut-away portion 5B bears against the roller cleaning brush 18 and rotates about the sheet feeding roller shaft 7 while pushing up this roller cleaning brush 18. By this rotation, the substance such as paper powder adhering to the surface of the roller cleaning brush is scraped off by the scraper 10.

By the substance adhering to the surface of the roller cleaning brush 18 being thus scraped off by the scraper 10, the accumulation of paper power on the roller cleaning brush 18 can be prevented. Thereby, particularly, even when such paper from the surface of which fibrous paper powder is simply stripped off is used, the cleaning effect of the roller cleaning brush 18 can be kept long and the conveying performance of the sheet feeding roller 5 can be maintained.

Figure 4A:
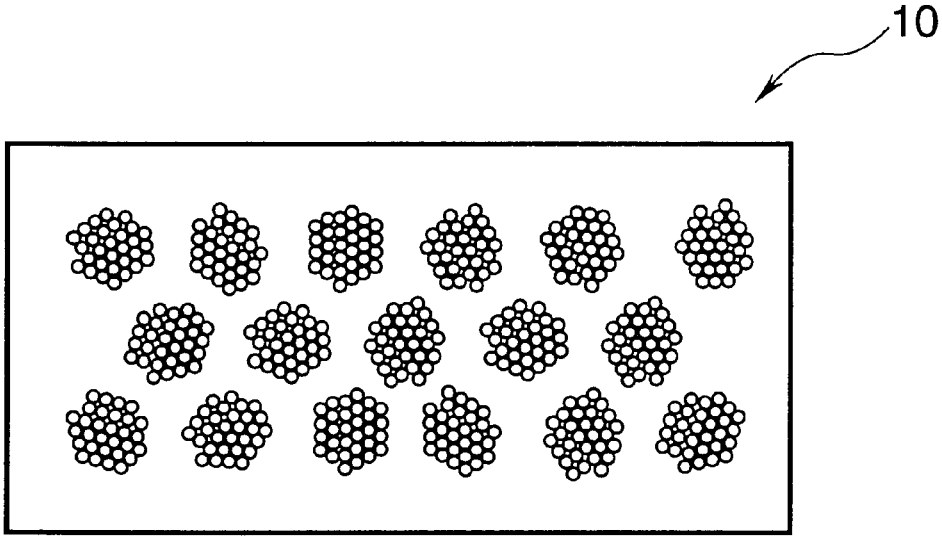
FIGS. 4A and 4B are plan views showing examples of a brush member constituting the scraper.
Figure 4B:
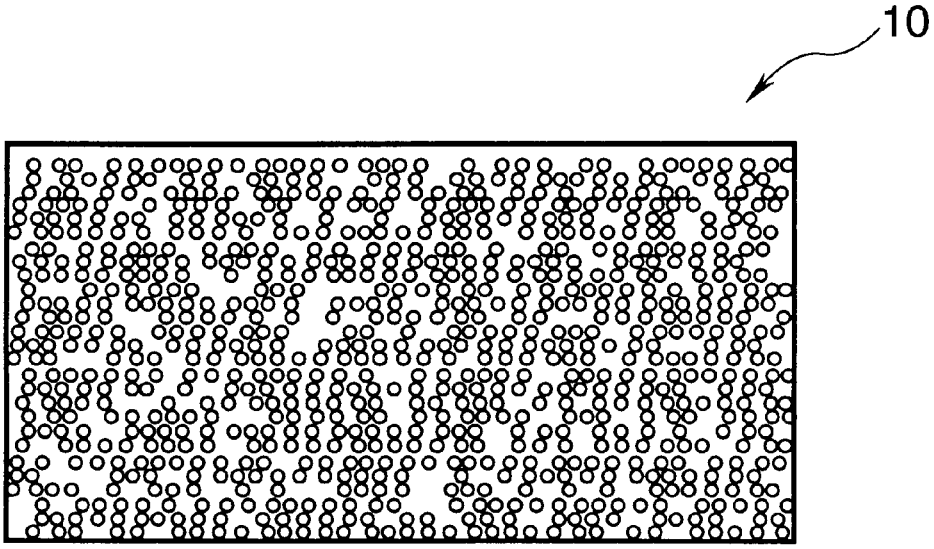

Now, FIGS. 4A and 4B are plan views showing examples of a brush member constituting the scraper 10, FIG. 4A showing a brush member comprising wires such as yarn or hair discretely implanted by ordinary press-in, and FIG. 4B showing a brush member comprising wires implanted at random and uniform density without any congregated portion.

Here, comparing the two brush members without other in the effect of removing paper powder collected on the roller cleaning brush 18 formed by a brush-like member of high density, the brush member shown in FIG. 4B is higher in the cleaning effect than the brush member shown in FIG. 4A. This is because the wires of the brush member of FIG. 4B can more easily come into the roller cleaning brush 18 and has the effect of scraping out paper powder or the like which has come into the deep portions of the roller cleaning brush 18. The appropriate density of the wires of the brush member shown in FIG. 4B is preferably 1400 to 2000 lines/inch$^2$.

Now, when the scraper 10 is to be mounted on the sheet feeding roller collar 6 by hair implanting or adhesive securing, there is a side lacking reliability in respect of the custody of rubber and the coupling strength of the scraper 10 to the sheet feeding roller collar 6. So, a scraper holder for holding the scraper 10 is discretely provided and it is mounted on the sheet feeding roller 5, whereby any irregularity and error in the manufacturing process can be eliminated and it becomes possible to manufacture parts more stably.

Description will now be made of a second embodiment of the present invention which is a construction in which provision is made of a scraper holder for holding the above-described scraper.

Figure 5:
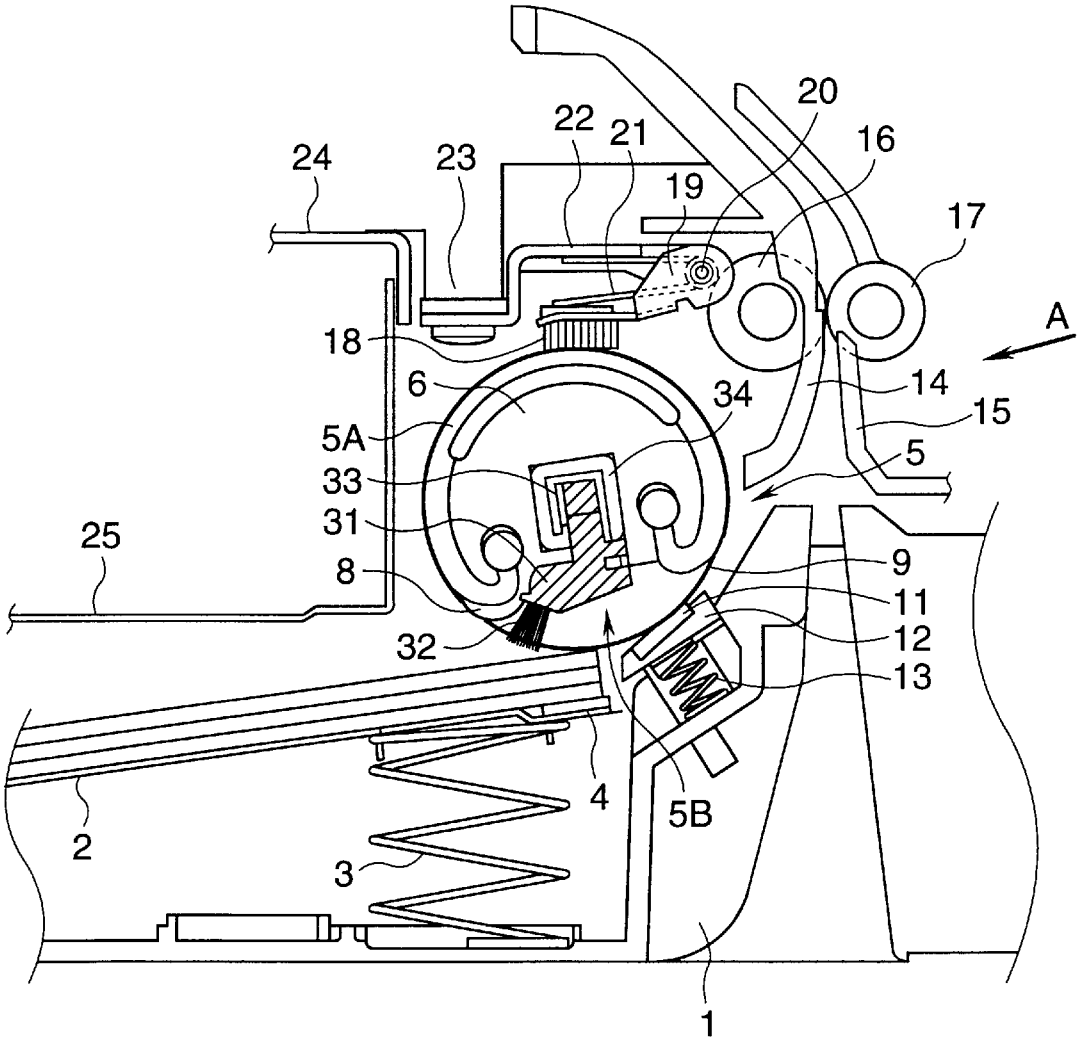
FIG. 5 is a schematic cross-sectional view showing the construction of a sheet feeding device according to a second embodiment of the present invention.
Figure 6:
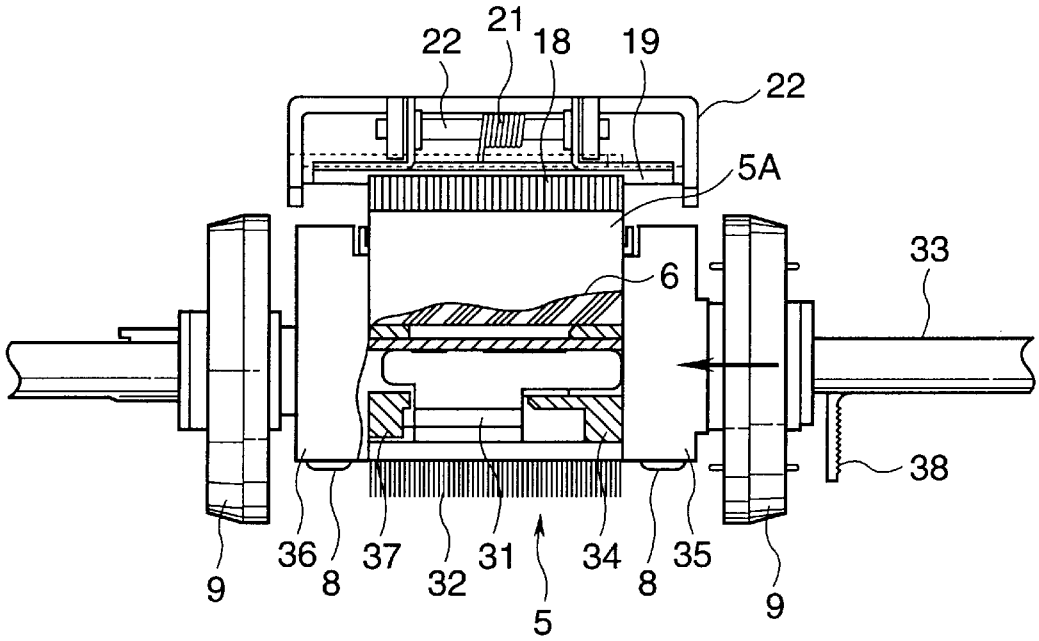
FIG. 6 is a side view taken in the direction of arrow A in FIG. 5.

FIG. 5 is a schematic cross-sectional view showing the construction of a sheet feeding device according to the present embodiment, and FIG. 6 is a side view taken in the direction of arrow A in FIG. 5. In FIGS. 5 and 6, the same reference numerals as those in FIG. 2 designate the same or corresponding portions.

In FIGS. 5 and 6, the reference numeral 31 designates a scraper holder interchangeably mounted on the sheet feeding roller 5, and the reference numeral 32 denotes a scraper mounted on this scraper holder 31. The reference numeral 33 designates a sheet feeding square shaft, and the reference numerals 35 and 36 denote first and second sheet feeding cams fitted to the sheet feeding square shaft 33 and holding the sheet feeding roller collar 6. The first and second sheet feeding cams 35 and 36 are provided to contact with the sheet immediately before the sheet feeding roller 5 contacts with the sheet, and push down the intermediate plate 2 to thereby eliminate bad sheet feeding occurring due to the level difference between the sheet feeding roller 5 and the idler roller 9. The reference numerals 34 and 37 designate holding pieces projectedly provided so as to be opposed to the first and second sheet feeding cams 35 and 36, respectively, and holding the scraper holder 31.

Here, at least the first sheet feeding cam 35 and the idler roller 9 on this first sheet feeding cam side are movable as regulating means along the sheet feeding square shaft 33 to thereby regulate the sheet feeding roller 5, and usually the first sheet feeding cam 35 and the idler roller 9 are positioned in a thrust direction by a stopper member 38. The sheet feeding operation and the roller cleaning brush cleaning operation in the thus constructed present embodiment are equal to those in the already described first embodiment.

Description will now be made of a method of assembling the scraper holder 31. It is to be understood that the assembly of the scraper holder 31 is effected with the sheet supply tray 1 removed from the sheet feeding device.

The stopper member 38 is first operated to release the positioning of the first sheet feeding cam 35 and the idler roller 9, whereafter the first sheet feeding cam 35 and the idler roller 9 are moved in the direction opposite to the direction of arrow indicated in FIG. 6. When the first sheet feeding cam 35 is thus moved, the holding piece 34 of the first sheet feeding cam 35 is also moved, whereby the holding of the sheet feeding roller collar 6 by the holding piece 34 is released, and the removal of the sheet feeding roller 5 becomes possible.

Figure 7:
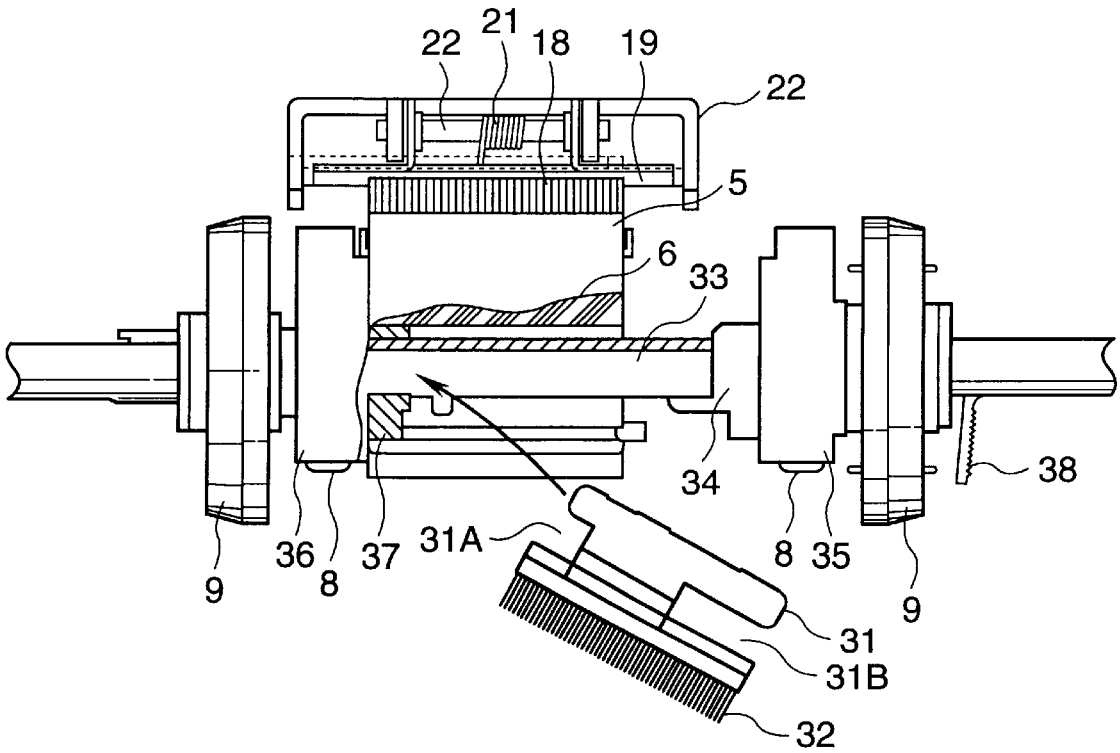
FIG. 7 illustrates a method of mounting a scraper holder in the second embodiment.

Next, the sheet feeding roller 5 is removed, whereafter a new scraper holder 31 is inserted obliquely as shown in FIG. 7, and a first locking portion 31A of the scraper holder 31 is locked by the holding piece 37 of the second sheet feeding cam 36, and the scraper holder 31 is held by the second sheet feeding cam 36.

Next, the first sheet feeding cam 35 and the idler roller 9 are moved in the direction of arrow indicated in FIG. 6, and a second locking portion 31B of the scraper holder 31 is locked by the holding piece 34 of the first sheet feeding cam 35. Thereby, the scraper holder 31 is held by the first and second sheet feeding cams 35 and 36. When the first sheet feeding cam 35 and the idler roller 9 are moved to a position in which the scraper holder 31 is thus held, the stopper member 38 is locked by a locking portion, not shown, whereby the first sheet feeding cam 35 and the idler roller 9 are positioned and fixed.

By the scraper 32 being thus interchangeably mounted on the sheet feeding roller 5, only the sheet feeding roller rubber 5A can be interchanged when the sheet feeding roller rubber 5A has reached its life, and the independent control of the life of the scraper 32 becomes possible.

Description will now be made of a third embodiment of the present invention in which the sheet feeding roller 5 is made interchangeable.

Figure 8:
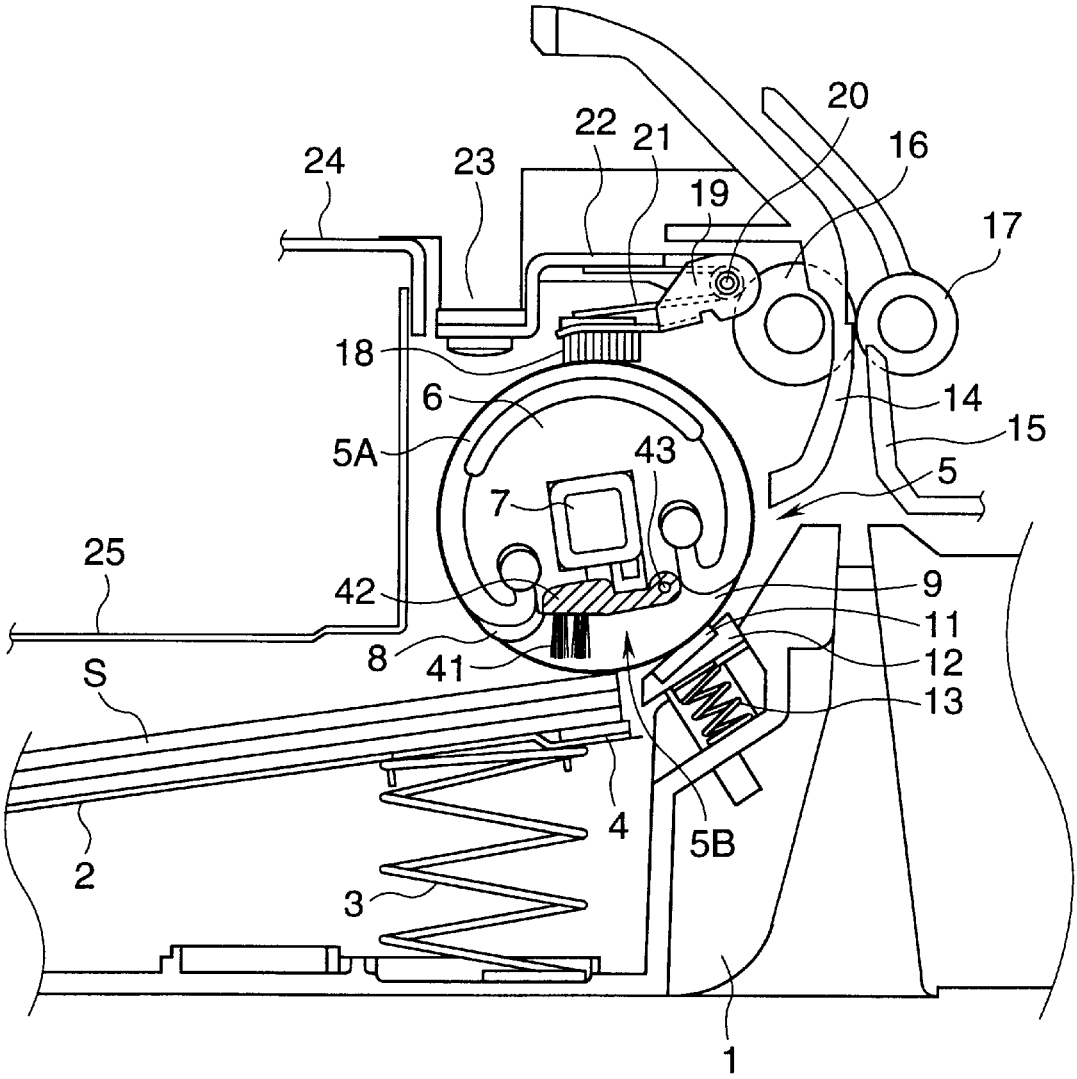
FIG. 8 is a schematic cross-sectional view showing the construction of a sheet feeding device according to a third embodiment of the present invention.

FIG. 8 is a schematic cross-sectional view showing the construction of a sheet feeding device according to the present embodiment, and in FIG. 8, the same reference numerals as those in FIG. 2 designate the same or corresponding porions.

In FIG. 8, the reference numeral 41 designates a scraper, and the reference numeral 42 denotes a scraper holder which is rotatably mounted on the sheet feeding collar 6 through a rotation shaft 43 so as to be retracted from a cleaning position.

Now, the sheet feeding roller collar 6 has an opening portion 6A as shown in FIG. 9 so as to make the sheet feeding roller 5 removably mountable with respect to the sheet feeding square shaft 7. Usually the scraper holder 42 is held at a position which closes the opening portion 6A by restraining means, not shown, provided on the sheet feeding roller collar 6, whereby the sheet feeding roller 5 is prevented from falling off from the sheet feeding square shaft 7. The sheet feeding operation and the roller cleaning brush cleaning operation in the present embodiment thus constructed are the same as those in the already described first embodiment.

A method of mounting the thus constructed sheet feeding roller 5 will now be described with reference to FIGS. 9A to 9C. It is to be understood that the mounting of the sheet feeding roller 5 is effected with the sheet supply tray 1 removed from the sheet feeding device.

Figure 9A:
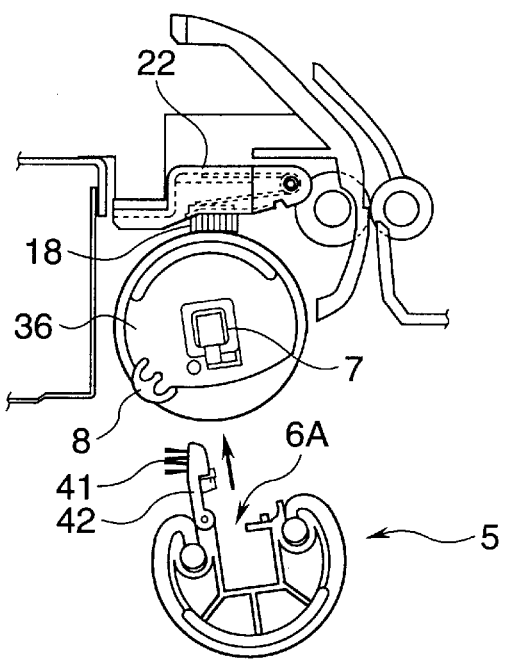
FIGS. 9A, 9B and 9C illustrate a method of mounting a sheet feeding roller in the third embodiment.

When the sheet feeding roller 5 is to be mounted, the scraper holder 42 is first rotated as shown in FIG. 9A to thereby open the opening portion 6A of the sheet feeding roller collar 6, whereafter it is inserted in a direction indicated by arrow and the sheet feeding roller 5 is rammed against the sheet feeding square shaft 7.

Figure 9B:
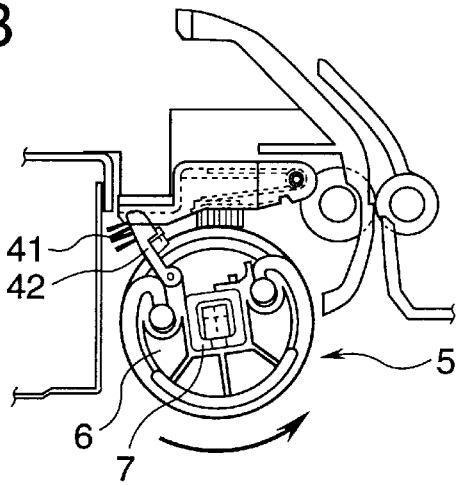
Figure 9C:
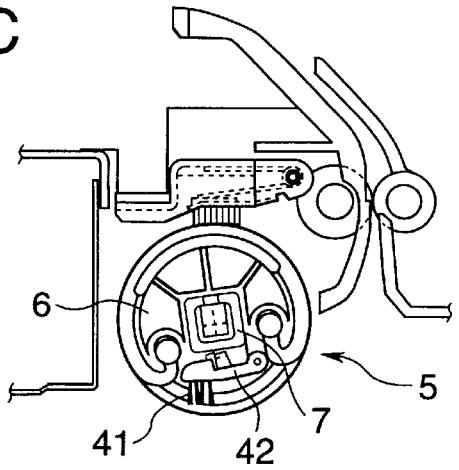

After the sheet feeding roller 5 has been rammed against the sheet feeding square shaft 7, the sheet feeding roller 5 is rotated by about 180° in the direction of arrow as shown in FIG. 9B. Thereafter, as shown in FIG. 9C, the scraper holder 42 is closed. Thereafter, the thrust direction of the sheet feeding roller 5 is fixed by means, not shown.

As described above, when the scraper 41 is to be rotatably mounted on the sheet feeding roller 5 so as to be retracted from the cleaning position and the sheet feeding roller 5 is to be mounted on the sheet feeding square shaft 7, this scraper 41 is rotated, whereby the sheet feeding roller 5 can be simply mounted on the sheet feeding square shaft 7. Thereby, the scraper 41 can be simply interchanged together with the sheet feeding roller 5.

In the foregoing, description has been made of a case where the scraper holder 42 is rotatably assembled to the sheet feeding roller collar 6, whereas the present embodiment is not restricted thereto, but the scraper holder 42 may be removably mounted on the sheet feeding roller collar 6. Thereby, the reutilization of only the scraper 41 becomes possible.

Now, when the outer diameter of the sheet feeding roller 5 is small, even if a scraper of a fixed type is disposed, the contact thereof with the roller cleaning brush may become insufficient in some cases.

Description will now be made of a construction designed such that even when the outer diameter of the sheet feeding roller 5 is small as described above, the cleaning of the roller cleaning brush can be reliably effected.

Figure 10:
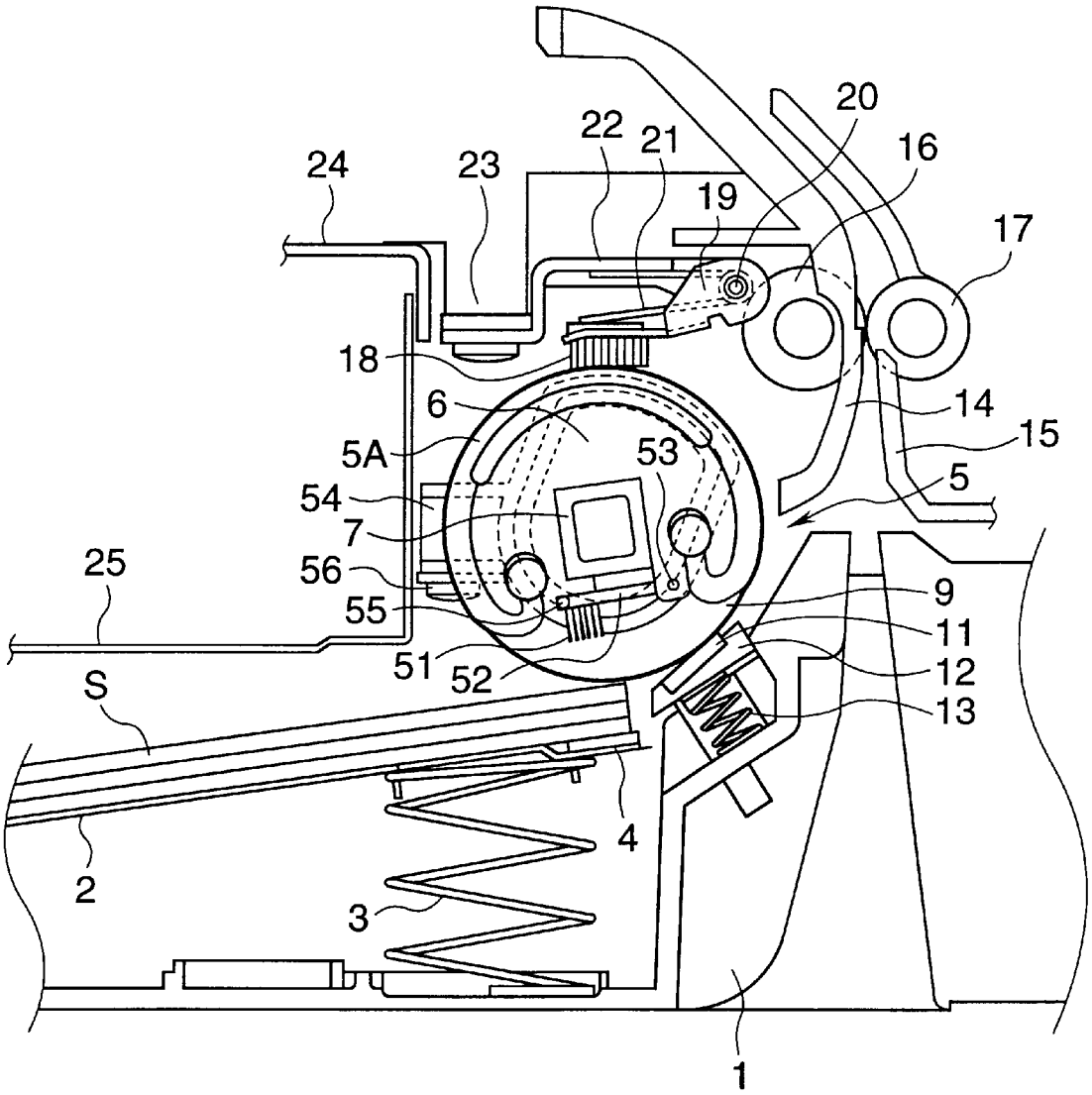
FIG. 10 is a schematic cross-sectional view showing the construction of a sheet feeding device according to a fourth embodiment of the present invention.
Figure 11:
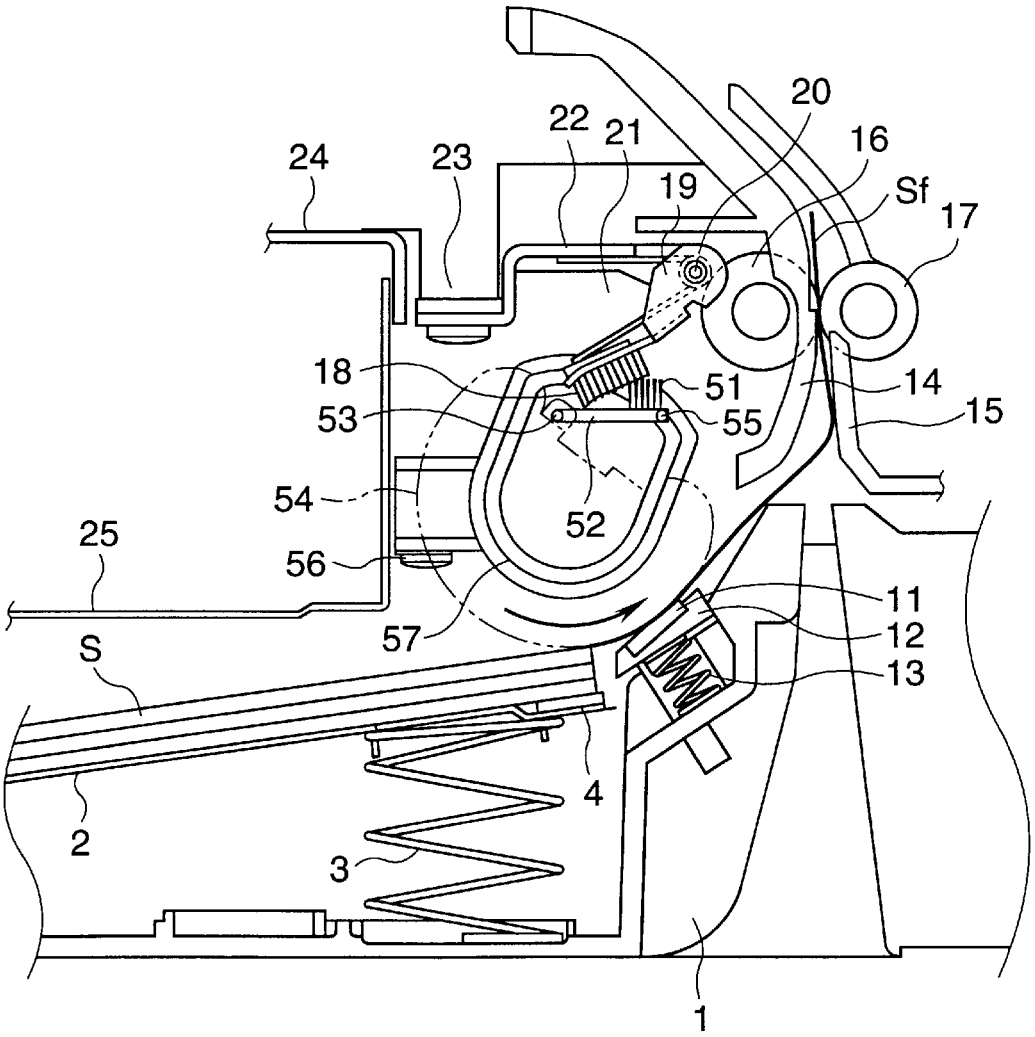
FIG. 11 shows a state in which a sheet feeding roller is excepted from FIG. 10.

FIG. 10 is a schematic cross-sectional view showing the construction of such a sheet feeding device according to a fourth embodiment of the present invention, and FIG. 11 shows a state in which the sheet feeding roller 5 is excepted from FIG. 10. In FIGS. 10 and 11, the same reference numerals as those in FIG. 2 designate the same or corresponding portions.

In FIGS. 10 and 11, the reference numeral 51 designates a scraper, and the reference numeral 52 denotes a scraper holder, and one end portion of this scraper holder 52 is formed with a boss, not shown, supported in a shaft hole 53 formed in the sheet feeding roller collar 6, and the other end portion thereof is formed with a follower boss 55.

The reference numeral 54 designates a cam block which is a guide member fixed to a casing 25, and this cam block 54 is formed with a cam surface 57 for restraining the follower boss 55 of the scraper holder 52 and guiding the scraper holder 52 (the scraper 51) to a position in which the cleaning of the roller cleaning brush 18 becomes possible.

Design is made such that by the follower boss 55 being locked on the cam surface 57 of the scraper holder 52, the scraper holder 52 is moved to a position in which the cleaning of the roller cleaning brush 18 becomes possible as shown in FIG. 11, by the follower boss 55 moved with the rotation of the sheet feeding roller 5 while changing its posture.

The reference numeral 56 denotes a screw for fixing the cam block 54 to the casing 25. The sheet feeding operation and the sheet feeding roller rubber cleaning operation in the present embodiment are the same as those in the first embodiment.

The cleaning operation for the roller cleaning brush 18 will now be described.

The posture of the scraper holder 52 is determined by the cam surface 57 and the follower boss 55 operatively associated therewith. In the standby shown in FIG. 10, the scraper 51 and the scraper holder 52 are in a position facing the piled surface of the sheets.

Next, when the sheet feeding roller 5 is rotated and sheet feeding is being effected and the scraper 51 has come into a phase for cleaning the roller cleaning brush 18, the scraper holder 52 is rotatably moved about the shaft hole 53 with the follower boss 54 moved along the cam surface 57 of the cam block 54, whereby the scraper 51 is moved to a position in which it contacts with the roller cleaning brush 18 as shown in FIG. 11. When thereafter, the sheet feeding roller 5 is further rotated, the cleaning of the roller cleaning brush 18 by the scraper 51 is effected.

As described above, by the use of the cam block 54, the scraper 51 is guided to the position in which the cleaning of the roller cleaning brush 18 becomes possible, whereby even when the diameter of the feeding roller is small, the cleaning of the roller cleaning brush 18 using the scraper 54 becomes possible. Also, by changing the shape of the cam surface 57, the position of contact of the scraper 54 with the roller cleaning brush 18 can be freely set and therefore, if the shape of the cam surface 57 is changed, even a roller cleaning brush 18 of different strength can be cleaned.

An example in which the sheet feeding roller, the roller cleaning brush and the scraper are integrally constructed as a unit will now be described as a fifth embodiment of the present invention.

Figure 12:
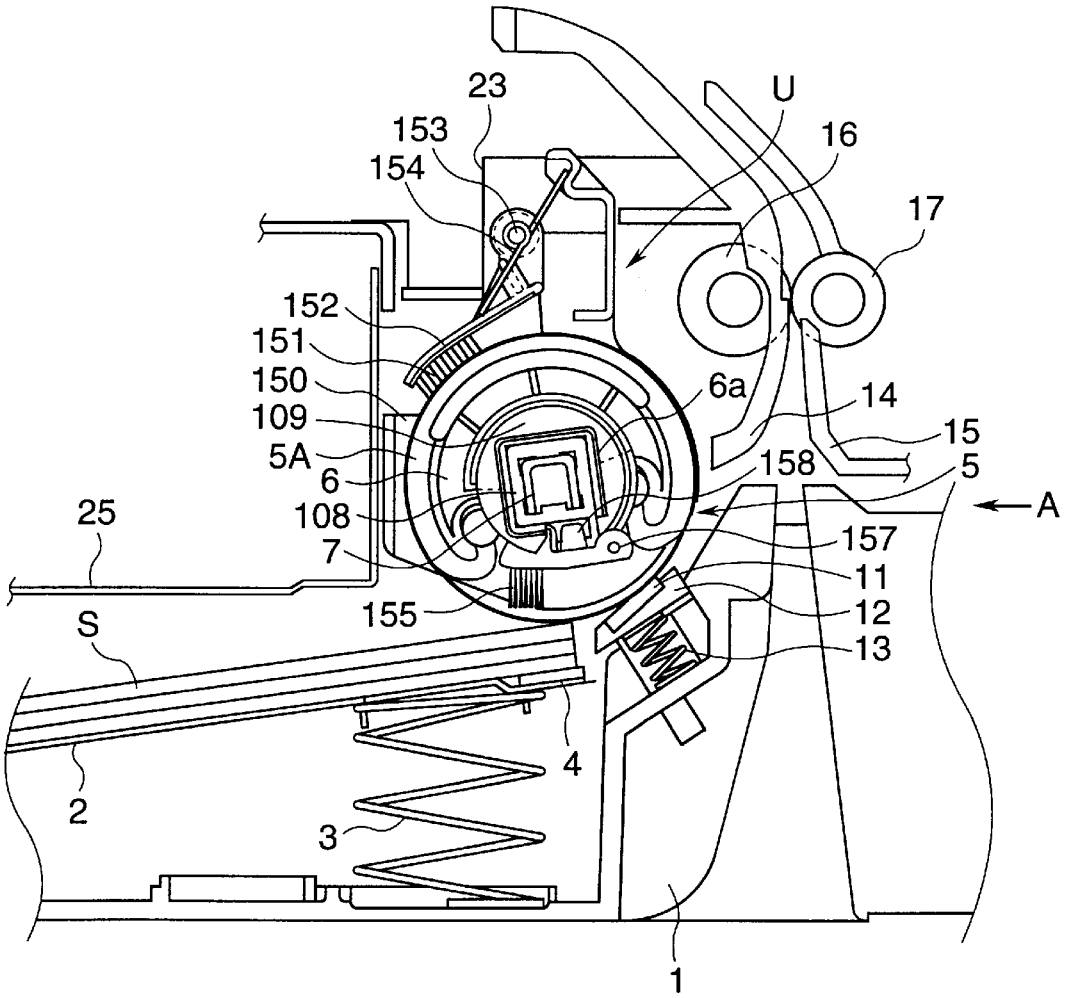
FIG. 12 is a schematic cross-sectional view showing the construction of a sheet feeding device according to a fifth embodiment of the present invention.

FIG. 12 is a schematic cross-sectional view of a sheet feeding device according to the present embodiment, and in FIG. 12, the same reference numerals as those in FIG. 2 designate the same or corresponding portions.

In FIG. 12, the reference numeral 150 designates a sheet feeding roller holder, the reference numeral 151 denotes a roller cleaning brush, and the reference numeral 152 designates a brush holder for holding the roller cleaning brush 151, and this brush holder 152 is rotatably supported on the sheet feeding roller holder 150 by a brush shaft 153 fixed to the sheet feeding roller holder 150.

The reference numeral 154 denotes a brush spring for urging the roller cleaning brush 151 against the sheet feeding roller rubber 5A, and this brush spring 154 has one end thereof supported by the sheet feeding roller holder 150 and the other end thereof supported by the brush holder 152.

The reference numeral 155 designates a scraper which is secondary cleaning means provided on the sheet feeding roller 5 for cleaning the roller cleaning brush 151 during each rotation of the sheet feeding roller 5, the reference numeral 156 denotes a scraper holder for holding the scraper 155, and the reference numeral 157 designates a shaft provided integrally with the sheet feeding roller collar 6, and the scraper holder 156 is rotatably and removably held on this shaft 157.

The reference numeral 158 denotes a hook portion formed integrally with the scraper holder 156, and this hook portion 158 is caught by the hooking surface, not shown, of the first sheet feeding cam 108 when the first sheet feeding cam 108 is assembled to the sheet feeding device, thereby fixing the scraper holder 156 against rotational movement.

In the present embodiment, the scraper holder 156 is fixed by the first sheet feeding cam 108 as described above, whereby there is constructed a sheet feeding roller unit U in which the sheet feeding roller 5, the roller cleaning brush 151 and the scraper 155 are integral with one another.

This sheet feeding roller unit U is assembled so that the directions of the opening portion 6A of the sheet feeding roller collar 6, the opening portions 109A and 124A, respectively, of the first and second sheet feeding roller joints 109 and 124, and the opening portion 110A of the sheet feeding roller holder 110 may coincide with one another. Also, the sheet feeding operation and the operation of cleaning the sheet feeding roller 5 in the present embodiment are the same as those in the first embodiment.

On the other hand, in the present embodiment, the cleaning of the roller cleaning brush 151 is effected as follows.

Figure 13:
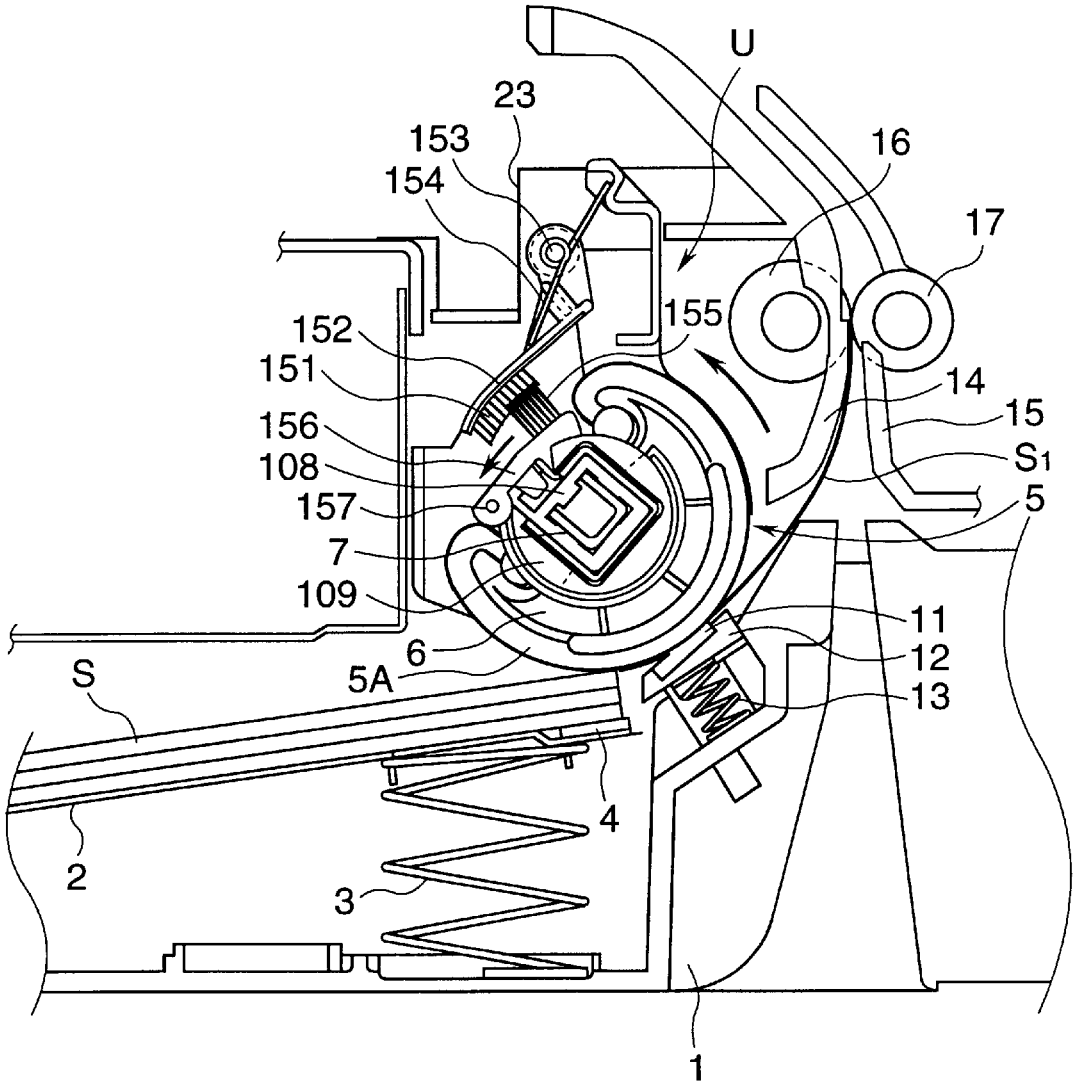
FIG. 13 illustrates the operation of a scraper in the fifth embodiment.

When the sheet feeding roller 5 is now rotated in the direction of arrow indicated in FIG. 13 to thereby convey a sheet $S_1$, the roller cleaning brush 151 follows and contacts with the surface shape of the sheet feeding roller rubber 5A by the force of the brush spring 154, and then comes into contact with the scraper 155 when the range of the sheet feeding roller rubber 5A terminates.

In this condition, paper powder, etc. adhering to the roller cleaning brush 151 is swept away by the pressure force determined by the brush spring 154 and the movement of the scraper 155 by the rotation of the sheet feeding roller 5. Thereby, the paper powder, etc. swept from the sheet feeding roller 5 adhering to the surface of the roller cleaning brush 151 is periodically removed.

A method of interchanging the sheet feeding roller unit U will now be described with reference to FIGS. 14 and 15. It is to be understood that the interchange of the sheet feeding roller unit U is effected with the sheet supply tray 1 removed from the sheet feeding device.

Figure 14:
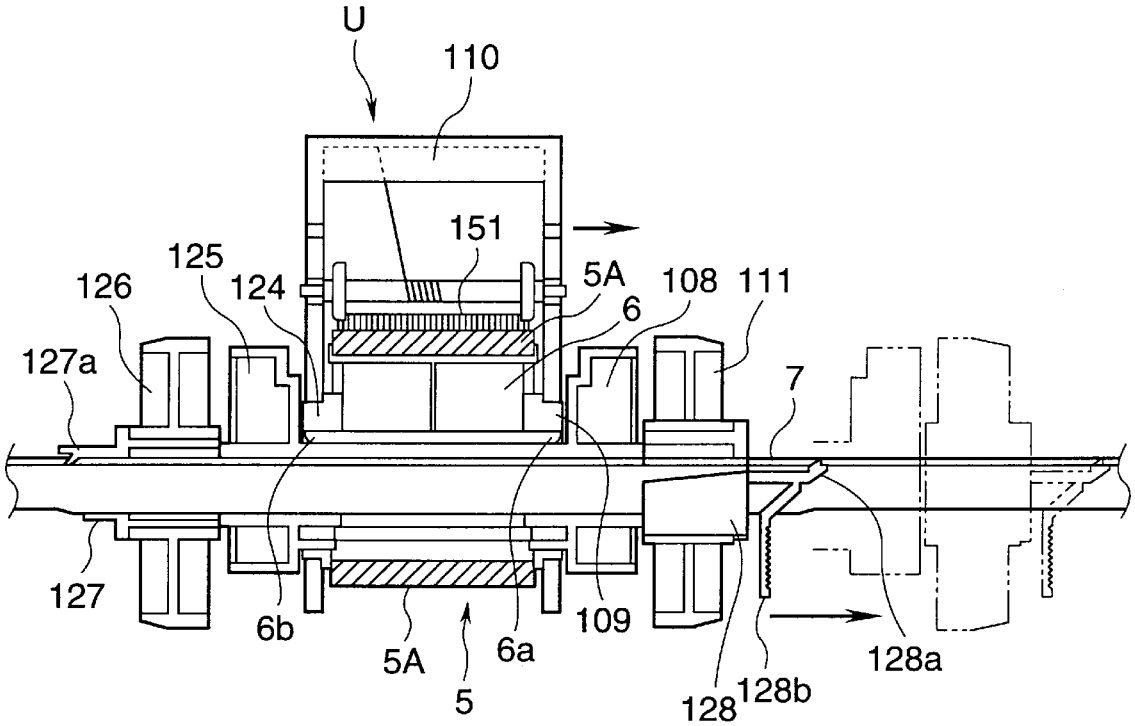
FIG. 14 is a side view taken in the direction of arrow A in FIG. 12.

The operating arm **128*b* of the first roller holder 128 is first operated to thereby release the fixing operation of the snap fit portion 128*a*, and the roller 111, etc. are moved to positions indicated by dots-and-dash lines in FIG. 14. Next, as shown in FIG. 15, the sheet feeding roller 5 is rotated by about 180°, whereafter the scraper holder 156 is rotatably moved about the shaft 157 in a direction to open the opening portion 6A of the sheet feeding roller collar 6, the opening portions 109A and 124A, respectively, of the first and second sheet feeding roller joints 109 and 124, and the opening portion 110A of the sheet feeding roller holder 110**, and thereafter the sheet feeding roller unit U is pulled out in the direction of arrow.

Thereby, the sheet feeding roller unit U can be simply removed. When the sheet feeding roller unit U is removed, the ends of the roller cleaning brush 151 and the brush holder 152 come into the sheet feeding roller holder 150 by the spring force of the brush spring 154, as shown in FIG. 15.

Figure 15:
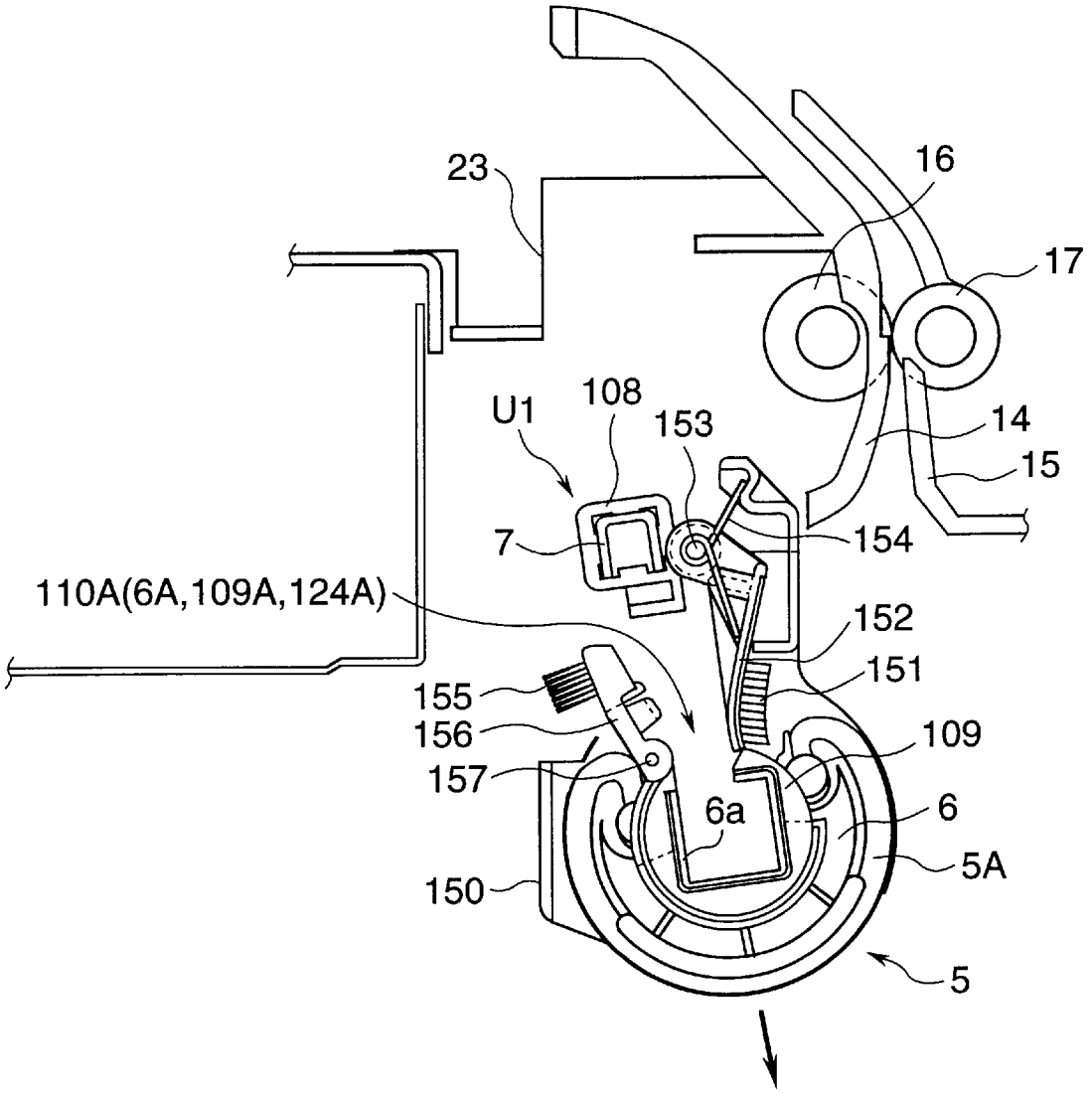
FIG. 15 is a schematic cross-sectional view showing a method of mounting a sheet feeding roller unit in the fifth embodiment.

On the other hand, when a new sheet feeding roller unit U after the interchange is to be mounted, the sheet feeding roller unit U assembled so that the directions of the opening portion 6A of the sheet feeding roller collar 6, the opening portions 109A and 124A, respectively, of the first and second sheet feeding roller joints 109 and 124 and the opening portion 110A of the sheet feeding roller holder 110 may coincide with one another is pushed in the direction opposite to the direction of arrow in FIG. 15, whereafter the scraper holder 156 is rotated about the shaft 157 in a direction to close the opening portion 6A of the sheet feeding roller collar 6, etc.

Thereafter, the sheet feeding roller 5 is rotated by about 180° and is moved in the direction opposite to the direction of arrow in FIG. 14, and subsequently the first sheet feeding cam 108 which is regulating means and the first idler roller 111 are moved in the same direction, whereby the mounting of the sheet feeding roller unit U is completed. By interchanging the sheet feeding roller unit U in which the sheet feeding roller 5, the roller cleaning brush 151 and the scraper 155 are made integral with one another as described above, the sheet feeding roller 5, the roller cleaning brush 151 and the scraper 155 can be simply interchanged and mounted in a state integral with the sheet feeding device.

Also, if design is made such that the scraper 155 is not rotated but is removed beforehand from the sheet feeding roller unit U, the sheet feeding roller unit U will come to fall from a gravity by simply rotating the sheet feeding roller 5 by 180°, and can be removed easily.

Also, by making the sheet feeding roller unit U into an integral service part and supplying it, the structure thereof can be simplified and the induction of an error in the service work in the market can be prevented, and it becomes possible to obviate the trouble caused by the error.

Description will now be made of a modification constructed such that in the sheet feeding device according to the above-described fifth embodiment, the lumps of paper powder piling on the brush holder may not fall onto the sheet feeding roller.

Figure 16:
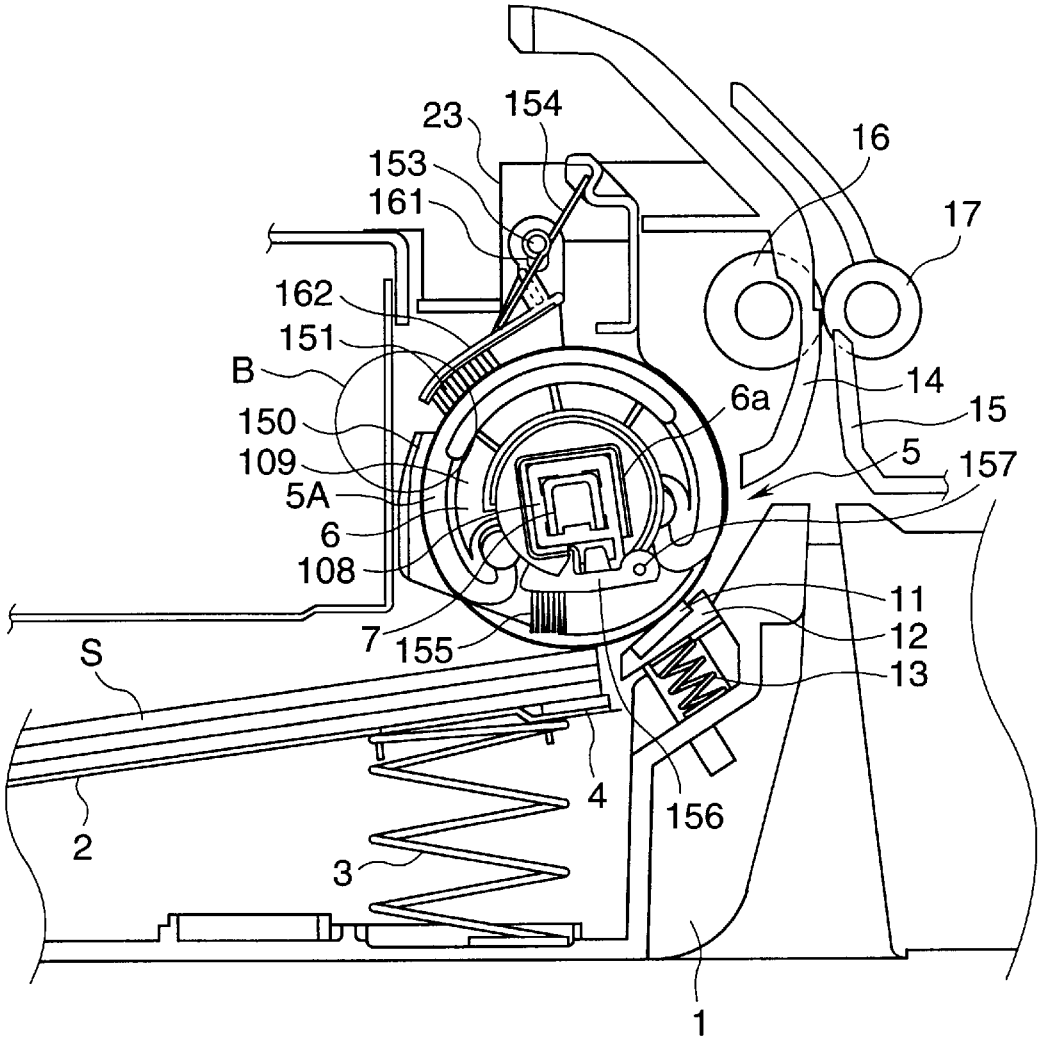
FIG. 16 is a schematic cross-sectional view showing the construction of a sheet feeding device according to a modification of the fifth embodiment.

FIG. 16 is a schematic cross-sectional view of a sheet feeding device according to the present embodiment, and in FIG. 16, the same reference numerals as those in FIG. 12 designate the same or corresponding portions.

Figure 17:
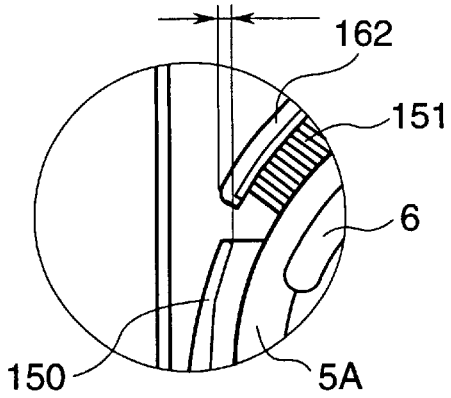
FIG. 17 is a partial detailed view of the sheet feeding device according to the modification of the fifth embodiment.

In FIG. 16, the reference numeral 162 designates a brush holder, of which the tip end portion is formed so that the wall surface of the sheet feeding roller holder 150 which is a frame member and the tip end of the brush holder 162 overlap each other in a vertical direction, as shown in FIG. 17 which is a detailed view of a portion B in FIG. 16. That is, the tip end of the brush holder 162 is provided so as to protrude to the side opposite to the sheet feeding roller 5 with respect to the vertical tangential line of the circumference of the sheet feeding roller 5.

A shaft hole 161 is formed in the upper portion of the brush holder 162 so as to support the brush shaft 153, and this shaft hole 161 has the shaft of a vertically long slot so as to be capable of securing the vertical movement of the brush holder 162. By thus making the shaft hole 161 into the slot shape, when the sheet feeding roller unit U is to be interchanged, the brush holder 162 can be moved upwardly, whereby without the tip end thereof interfering with the sheet feeding roller collar 6, the brush holder 162 can go into the sheet feeding roller holder 150 as shown in FIG. 15 already described.

The sheet feeding operation, the cleaning operation for the sheet feeding roller and the cleaning operation for the roller cleaning brush in the present embodiment are the same as those in the fifth embodiment.

Now, as the result of a test in which a great deal of paper producing much paper powder was actually supplied in the fifth embodiment, it has been found that the paper powder, etc. swept away from the roller cleaning brush 151 by the scraper 155 waft near the brush and accumulate on a portion in which the stream of wind is weak, for example, on the upper surface of the brush holder 162 which is the side opposite to the side facing the sheet feeding roller 5.

In the present embodiment, however, even if the paper powder accumulates on the upper surface of the brush holder 162 as described above and soon lumps of paper powder fall from the tip end of the brush holder 162, lumps of paper powder directly accumulating on the sheet feeding roller 5 do not fall because as already described, the wall surface of the sheet feeding roller holder 150 and the tip end of the brush holder 162 overlap each other in the vertical direction.

Thereby, the paper powder, etc. adhering to the sheet feeding roller 5 can be prevented from re-adhering to the surface of the sheet feeding roller 5. Also, during the mounting and dismounting of the sheet feeding roller unit U, the paper powder falls from gravity and therefore, the cleaning work for the interior of the apparatus body becomes unnecessary.

In the present embodiment, description has been made of a construction in which the wall surface of the sheet feeding roller holder and the tip end of the brush holder overlap each other in the vertical direction, whereas the present invention is not restricted thereto, but it is self-evident that a construction in which the two overlap each other as viewed from a direction orthogonal to the outer peripheral surface of the sheet feeding roller 5 can also result in a similar effect.

Description will now be made of a modification constructed such that in the sheet feeding device according to the above-described fifth embodiment, the lumps of paper powder accumulating on the brush holder and falling therefrom are held.

Figure 18:
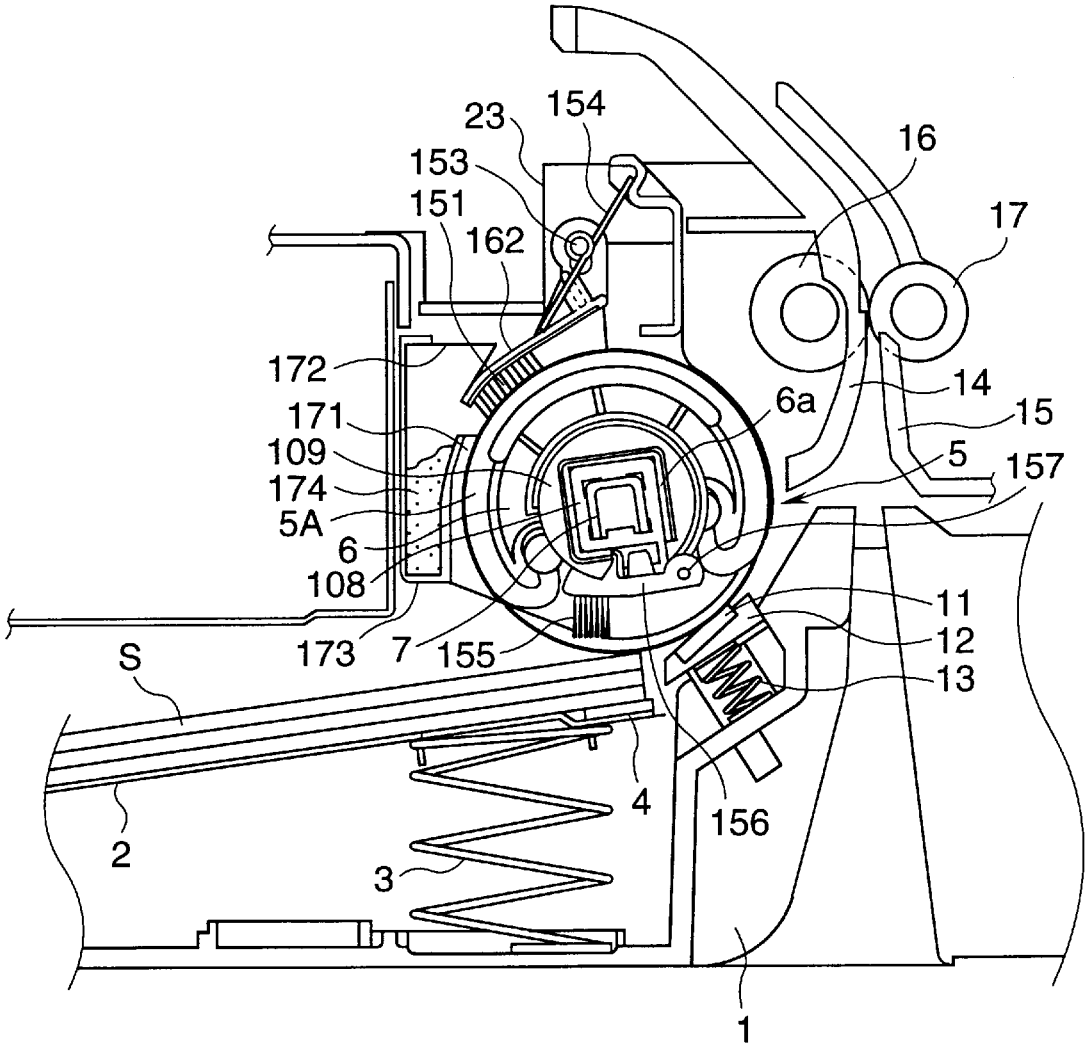
FIG. 18 is a schematic cross-sectional view showing the construction of a sheet feeding device according to a modification of the fifth embodiment.
Figure 19:
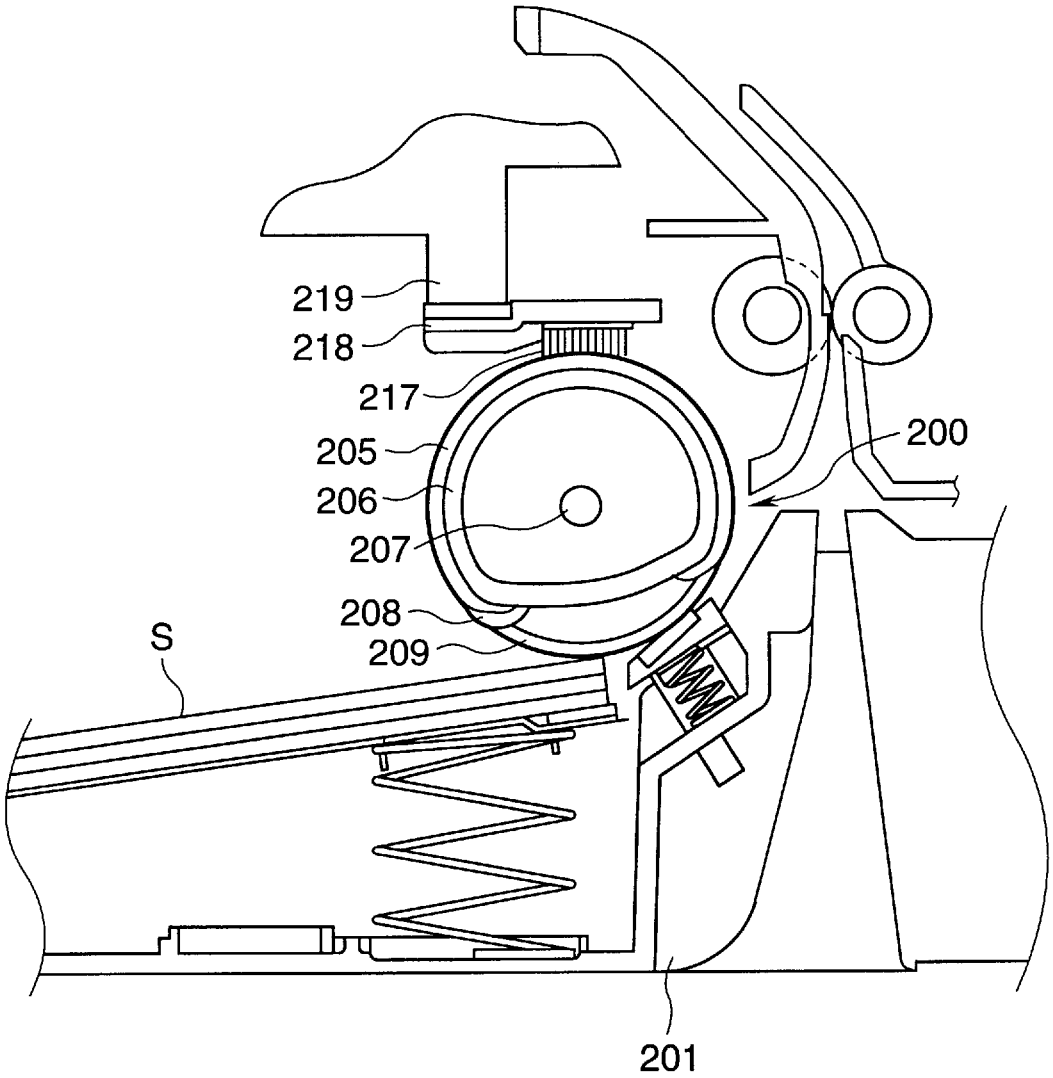
FIG.19 PRIOR ART
FIG. 19 is a schematic cross-sectional view showing the construction of a sheet feeding device according to the prior art.

FIG. 18 is a schematic cross-sectional view of a sheet feeding device according to the present embodiment, and in FIG. 18, the same reference numerals as those in FIG. 16 designate the same or corresponding portions.

In FIG. 18, the reference numeral 171 designates a sheet feeding roller holder, and the reference numeral 172 denotes a paper powder block capable of temporarily holding thereon lumps of paper powder collecting on the upper surface of the brush holder 162. The reference numeral 174 designates a paper powder container for holding therein lumps of paper powder 175 temporarily collecting on the paper powder block 172, and then falling downwardly from gravity or shock or the like, and this paper powder container 174 is integrally mounted on the sheet feeding roller holder 171, i.e., the sheet feeding roller unit U.

With such a construction, the matter adhering to the roller cleaning brush is swept away from the roller cleaning brush 151 by the scraper 155, whereafter it wafts around it temporarily, and paper powder adhering within a range partitioned by the paper powder block 172 grows into a lump of paper powder having a certain degree of size, and such lump of paper powder falls downwardly from gravity or shock or the like and collects in the paper powder container 174.

If thereafter, the sheet feeding roller unit U is interchanged, the sheet feeding roller 5, the roller cleaning brush 151, the scraper 155 and the paper powder container 174 in which the paper powder has collected can be interchanged at a time. Also, the place onto which the lumps of paper powder fall can be decided upon and can be held and therefore, the possibility of contamination by the paper powder can be eliminated.

While in the present embodiment, the paper powder container 174 for holding the lumps of paper powder 175 therein is provided integrally with the sheet feeding roller unit U, the present invention is not restricted thereto, but it is also possible to provide the above-described paper powder container for the sheet feeding roller 5 with which the scraper 41 described, for example, in Embodiment 3 is constructed integrally.

Also, in each of the above-described embodiments, the roller cleaning brush which is cleaning means is provided on the upper portion of the sheet feeding roller, whereas the present invention is not restricted thereto, but if there is a surplus in the installation space, the roller cleaning brush may be provided between the sheet feeding roller and the casing in FIG. 2, etc.

Also, in the present invention, the roller cleaning brush which is cleaning means is designed to normally contact with the sheet feeding roller rubber which is the sheet-contacting surface of the sheet feeding roller, whereas the present invention is not restricted thereto, but provision may be made of moving means for bringing the roller cleaning brush into contact with and away from the sheet feeding roller, whereby at predetermined timing, the roller cleaning brush may be brought into contact with the sheet-contacting surface of the sheet feeding roller to clean the latter.

What is claimed is:

1. A sheet feeding device for feeding a sheet comprising:

sheet supporting means for supporting the sheet thereon;

a sheet feeding roller for contacting with the sheet supported on said sheet supporting means to feed the sheet; and cleaning means for contacting with a portion of said sheet feeding roller which contacts with the sheet, and cleaning the portion;

said sheet feeding roller having a cut-away portion which does not contact with the sheet, and secondary cleaning means for cleaning said cleaning means being provided in said cut-away portion.

2. A sheet feeding device according to claim 1, wherein said secondary cleaning means effects the cleaning of said cleaning means with the rotation of said sheet feeding roller.

3. A sheet feeding device according to claim 1, further comprising an elastic member for biasing said cleaning means toward the circumference of said sheet feeding roller.

4. A sheet feeding device according to claim 1, wherein said sheet feeding roller has rubber which is the portion contacting with the sheet, and a collar supporting said rubber, and said secondary cleaning means is integrally mounted on said collar.

5. A sheet feeding device according to claim 1, wherein said secondary cleaning means is removably mounted in said cut-away portion.

6. A sheet feeding device according to claim 5, further comprising regulating means fitted to the shaft of said sheet feeding roller to regulate said sheet feeding roller and said secondary cleaning means, wherein said regulating means is moved in the direction of said shaft and said secondary cleaning means is removed from said cut-away portion, whereby said sheet feeding roller is mounted on or dismounted from said sheet feeding device.

7. A sheet feeding device according to claim 1, wherein said secondary cleaning means and said sheet feeding roller are constructed of a unit, and the operations of mounting and dismounting said unit are effected with said sheet supporting means removed from said sheet feeding device.

8. A sheet feeding device according to claim 7, wherein said secondary cleaning means is supported axially on said cut-away portion, and is provided retractably from a cleaning position to mount or dismount said unit with respect to said sheet feeding device.

9. A sheet feeding device according to claim 8, wherein a container for holding therein removed matter removed from said cleaning means by said secondary cleaning means is provided in said unit.

10. A sheet feeding device according to claim 1, wherein a guide member for guiding said secondary cleaning means to a position in which said cleaning means can be cleaned, with the rotation of said sheet feeding roller.

11. A sheet feeding device according to claim 10, wherein said guide member comprises a cam having a cam surface formed so that said secondary cleaning means may protrude from said cut-away portion, and a boss provided on said secondary cleaning means and engaged with said cam.

12. A sheet feeding device according to claim 1, wherein said sheet feeding roller, said cleaning means and said secondary cleaning means are constructed as a unit provided integrally with a holder, and said unit are removably mounted on said sheet feeding device.

13. A sheet feeding device according to claim 12, further comprising an elastic member for biasing said cleaning means toward the circumference of said sheet feeding roller.

14. A sheet feeding device according to claim 12, wherein said regulating means fitted to the shaft of said sheet feeding roller to regulate said sheet feeding roller is moved in the direction of said shaft, and said secondary cleaning means is retracted from a position for cleaning said cleaning means, whereby said unit is mounted on or dismounted from said sheet feeding device.

15. A sheet feeding device according to claim 12, wherein when said unit is removed from said sheet feeding device, said cleaning means comes into the inside of said holder.

16. A sheet feeding device according to claim 12, wherein said cleaning means is provided in overlapping relationship with said sheet feeding roller so that the end portion thereof may protrude to the side opposite to said sheet feeding roller with respect to the vertical tangential line of the circumference of said sheet feeding roller.

17. A sheet feeding device according to claim 12, wherein a container for holding therein removed matter removed from said cleaning means by said secondary cleaning means is provided integrally with said unit.

18. A sheet feeding device according to claim 12, wherein the operations of mounting and dismounting said unit are effected with said sheet supporting means removed from said sheet feeding device.

19. A sheet feeding device according to claim 1, wherein said cleaning means is a brush member.

20. A sheet feeding device according to claim 1, wherein said second cleaning means is a brush member.

21. A sheet feeding device according to claim 20, wherein said brush member of said secondary cleaning means comprises wires constituting a brush which are provided at random and uniform density.

22. A sheet feeding device according to claim 21, wherein the density of the wires of said brush member is 1400 to 2000 lines/inch.

23. A sheet feeding device according to claim 1, further comprising moving means for moving said cleaning means into contact with and away from the sheet-contacting surface of said sheet feeding roller.

24. An image forming apparatus for forming an image on a sheet comprising:

image forming means for forming an image on the sheet;

sheet supporting means for supporting thereon the sheet for forming an image thereon;

a sheet feeding roller for contacting with the sheet supported on said sheet supporting means and feeding the sheet; and cleaning means for contacting with that portion of said sheet feeding roller which contacts with the sheet, and cleaning said contacting portion;

said sheet feeding roller having a cut-away portion which does not contact with the sheet, and secondary cleaning means for cleaning said cleaning means being provided in said cut-away portion.

* * * * *